US010344722B2

(12) United States Patent
Gebhardt et al.

(10) Patent No.: US 10,344,722 B2
(45) Date of Patent: Jul. 9, 2019

(54) FLUID INJECTOR

(71) Applicant: Continental Automotive GmbH, Hannover (DE)

(72) Inventors: Xaver Gebhardt, Kelheim (DE); Daniele Carli, Pisa (IT); Christoph Hamann, Thalmassing (DE); Ivano Izzo, Pisa (IT); Anatoliy Lyubar, Wolfsegg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 210 days.

(21) Appl. No.: 15/312,478

(22) PCT Filed: May 13, 2015

(86) PCT No.: PCT/EP2015/060647
§ 371 (c)(1),
(2) Date: Nov. 18, 2016

(87) PCT Pub. No.: WO2015/177030
PCT Pub. Date: Nov. 26, 2015

(65) Prior Publication Data

US 2017/0089309 A1 Mar. 30, 2017

(30) Foreign Application Priority Data

May 22, 2014 (EP) ..... 14169400

(51) Int. Cl.
*F02M 51/06* (2006.01)

(52) U.S. Cl.
CPC ... *F02M 51/0685* (2013.01); *F02M 2200/304* (2013.01)

(58) Field of Classification Search
CPC ..... F02M 51/061; F02M 51/0653; F02M 51/066; F02M 51/0664; F02M 51/0671;
(Continued)

(56) References Cited

U.S. PATENT DOCUMENTS 4,575,008 A * 3/1986 Kaczynski ..... F02M 61/08 239/533.11
7,774,126 B2 8/2010 Abe et al. ..... 701/104
(Continued)

FOREIGN PATENT DOCUMENTS

CN 101446254 A 6/2009 ..... F02M 61/16
DE 102012210424 A1 12/2013 ..... F02M 51/00
(Continued)

OTHER PUBLICATIONS

Chinese Office Action, Application No. 201580026481.6, 18 pages, dated Jun. 25, 2018.
(Continued)

*Primary Examiner* — Darren W Gorman
(74) *Attorney, Agent, or Firm* — Slayden Grubert Beard PLLC

(57) ABSTRACT

The present disclosure relates to fluid injection and the teachings thereof may be embodied in an injector. Some embodiments include an injector comprising: a valve with a valve body and a valve needle; an armature mechanically coupled to the valve needle for moving the valve needle away from a closing position; and a damping element. The valve needle moves in the valve body and seals the valve. The armature displaces the valve needle away from the closing position. The damping element comprises: a hydraulic chamber and a piston arranged to modify a fluid volume of the hydraulic chamber. The piston reduces the fluid volume of the hydraulic chamber when the valve needle moves away from the closing position. A flow restricting orifice hydraulically connects the hydraulic chamber to the cavity.

16 Claims, 1 Drawing Sheet

(58) Field of Classification Search
CPC ..... F02M 51/0685; F02M 2200/30; F02M 2200/304; F02M 2200/306
See application file for complete search history.

(56) References Cited

U.S. PATENT DOCUMENTS

| | | | | |
|---|---|---|---|---|
| 9,394,869 | B2 | 7/2016 | Berg et al. | |
| 2007/0215717 | A1 | 9/2007 | Cooke | 239/102.2 |
| 2008/0276907 | A1 | 11/2008 | Abe et al. | 123/472 |
| 2009/0108106 | A1 | 4/2009 | Ciampolini et al. | 239/533.12 |

FOREIGN PATENT DOCUMENTS

| | | | | |
|---|---|---|---|---|
| EP | 1693562 | A1 | 8/2006 | F02M 45/08 |
| EP | 1837515 | A1 | 9/2007 | F02M 47/02 |
| EP | 1837518 | A1 | 9/2007 | F02M 45/08 |
| JP | 2008280876 | A | 11/2008 | F02D 41/20 |
| WO | 2012/010357 | A1 | 1/2012 | F02M 51/06 |
| WO | 2013/189639 | A1 | 12/2013 | F02M 51/06 |
| WO | 2015/177030 | A1 | 11/2015 | F02M 51/06 |

OTHER PUBLICATIONS

Korean Office Action, Application No. 2018033003756, 17 pages, dated May 15, 2018.
Extended European Search Report, Application No. 14169400.0, 6 pages, dated Nov. 10, 2014.
International Search Report and Written Opinion, Application No. PCT/EP2015/060647, 9 pages, dated Aug. 4, 2015.

* cited by examiner

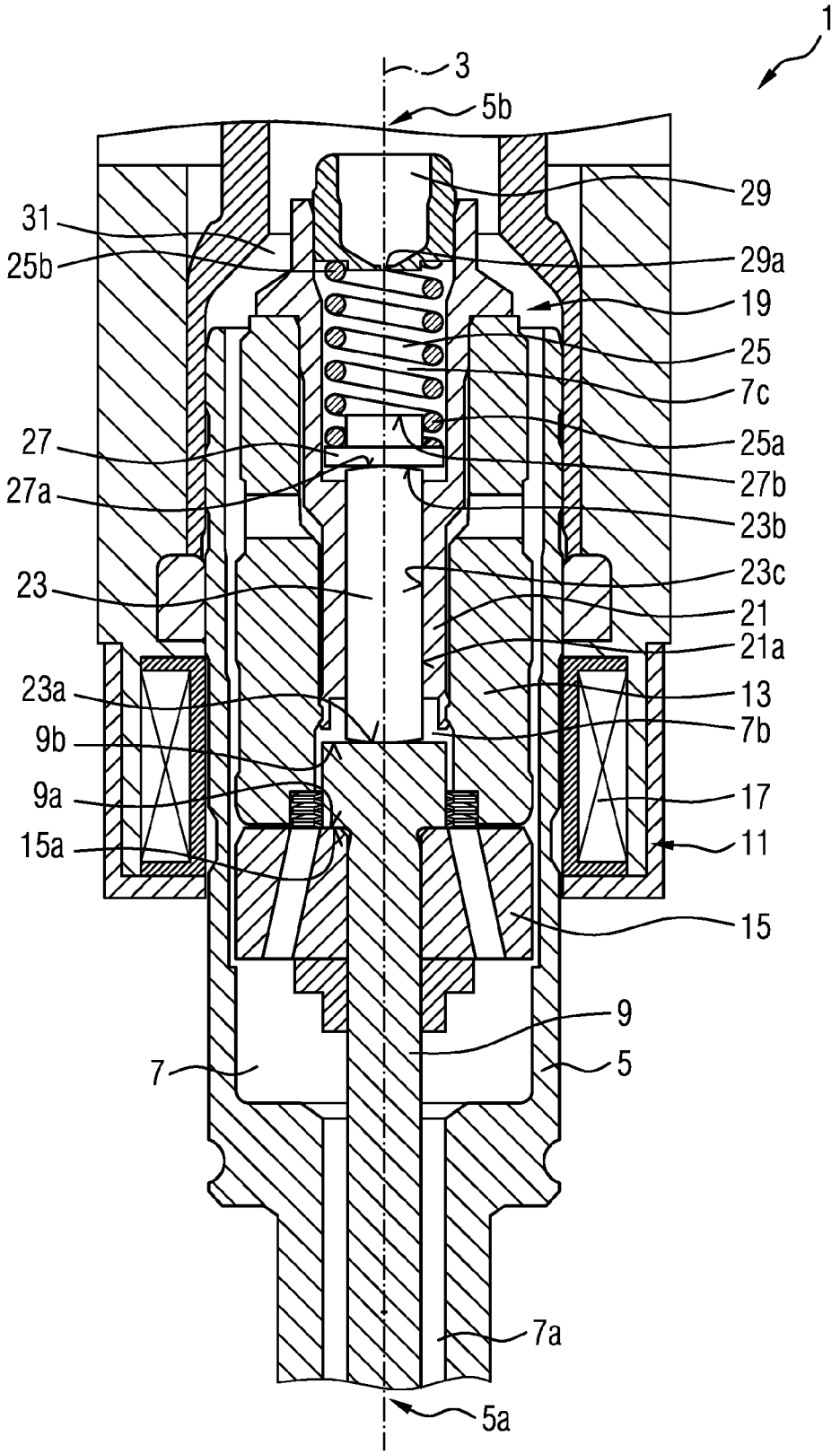
1
3
5b
29
31
29a
25b
19
25
7c
27
25a
27b
27a
23b
23c
23
21
21a
23a
13
9b
7b
9a
17
15a
11
15
9
7
5
7a
5a

FLUID INJECTOR

CROSS-REFERENCE TO RELATED APPLICATIONS

This application is a U.S. National Stage Application of International Application No. PCT/EP2015/060647 filed May 13, 2015, which designates the United States of America, and claims priority to EP Application No. 14169400.0 filed May 22, 2014, the contents of which are hereby incorporated by reference in their entirety.

TECHNICAL FIELD

The present disclosure relates to fluid injection and the teachings thereof may be embodied in an injector for injecting fluid and, in some examples, to an injector for injecting fuel into an internal combustion engine.

BACKGROUND

Injection valves are in widespread use, including in internal combustion engines. They may dose the fluid into an intake manifold of the internal combustion engine or directly into the combustion chamber of one or more cylinders of the internal combustion engine.

Injection valves may have various forms to satisfy various needs for various combustion engines. Therefore, for example, their length, diameter, as well as various elements of the injection valve responsible for the way the fluid is dosed, may vary within a wide range. In addition, injection valves may accommodate an actuator for actuating a valve needle of the injection valve, e.g., an electromagnetic actuator.

SUMMARY

To enhance the combustion process in regard to reduction of unwanted emissions, an injection valve may dose fluids under very high pressures. The pressures may be, in the case of a gasoline engine for example, in the range of up to 500 bar, and in the case of diesel engines in the range of up to 3500 bar. The teachings of the present disclosure may be embodied in an injector for injection fluid, which facilitates a reliable and precise function.

In some embodiments, an injector (1) for injecting fluid may include a valve comprising a valve body (5) and a valve needle (9), an armature (15) which is mechanically coupled to the valve needle (9) for moving the valve needle (9) away from a closing position, and a damping element (19). The valve body may (5) extend between a fluid outlet end (5*a*) and a fluid inlet end (5*b*) along a central longitudinal axis (3) and has a cavity (7). The valve needle (9) may be arranged axially movable relative to the valve body (5) in the cavity (7). The valve needle may be operable to seal the valve in the closing position, and is axially displaceable away from the closing position by the armature (15) to unseal the valve. The damping element (19) may be arranged within the cavity (7). The damping element (19) may include a hydraulic chamber (7*c*), a piston (23) being arranged axially movable relative to the valve body (5) such that it is operable to modify a fluid volume of the hydraulic chamber (7*c*) and being coupled with the valve needle (9) such that the piston reduces the fluid volume of the hydraulic chamber (7*c*) when the valve needle (9) moves away from the closing position for unsealing the valve, and a flow restricting orifice (29*a*) hydraulically connecting the hydraulic chamber (7*c*) to the cavity (7).

In some embodiments, the hydraulic chamber (7*c*) is positionally fixed relative to the valve body, the piston (23) and the valve needle (9) are releasably coupled, and the damping element (19) is configured such that fluid can be exchanged between the hydraulic chamber (7*c*) and the portion of the cavity (7) surrounding the hydraulic chamber (7*c*) only through the flow restricting orifice (29*a*).

Some embodiments include a return spring (25) for biasing the valve needle (9) towards the closing position. In some embodiments, a spring force of the return spring (25) is transferred to the valve needle (9) via the piston (23). In some embodiments, return spring (25) is positioned in the hydraulic chamber (7*c*).

In some embodiments, a cross-sectional area of the orifice (29*a*) is smaller than a cross-sectional area of the piston (23). In some embodiments, the cross-sectional area of the orifice (29*a*) is 1% or less, and in particular 0.05% or more, of the cross-sectional area of the piston (23).

In some embodiments, the diameter of the piston (23) depends on a given damping force of the damping element (19) on the valve needle (9).

In some embodiments, the cavity (7) shapes at least one fluid channel (31) extending axially along the hydraulic chamber (7*c*), enabling a fluid communication from the fluid inlet end (5*b*) of the valve body (5) to its fluid outlet end (5*a*). In some embodiments, the fluid channel (15) is arranged radially outside of the armature (15) with respect to the central longitudinal axis (3).

In some embodiments, the piston (23) and the valve needle (9) are releasably coupled, in particular via a form-fit engagement.

In some embodiments, the damping element (19) comprises a sleeve (21) having an axially extending sleeve wall (21*a*), the piston (23) has a bottom surface (23*a*), a top surface (23*b*) and a lateral surface (23*c*), the piston (23) is arranged axially movable within the sleeve (21), the bottom surface (23*a*) being coupled with the valve needle (9) and the lateral surface (23*c*) meeting the sleeve wall (21*a*).

In some embodiments, the return spring (25) is coupled with the top surface (23*b*) of the piston (23) with a first end (25*a*) and coupled with the valve body (5) with an opposed second end (25*b*) and preloaded to exert a force on the piston (23) that is pushing it towards the valve needle (9).

Some embodiments include a plate (27) being arranged axially movable within the hydraulic chamber (7*c*), being coupled with the top surface (23*b*) of the piston (23) with a first side (27*a*) and coupled with the first end (25*a*) of the return spring (25) with an opposed second side (27*b*).

BRIEF DESCRIPTION OF THE DRAWINGS

FIGURE is a drawing showing an exemplary embodiment of the teachings of the present disclosure. The teachings are further explained in the following description with the aid of the schematic drawing and reference numbers, showing an injector in a longitudinal section view.

DETAILED DESCRIPTION

In some embodiments, an injector for injecting fluid comprises a valve and a damping element. The valve comprises a valve body. The valve body extends between a fluid inlet end and a fluid outlet end along a central longitudinal axis. The valve body has a cavity. The cavity may comprise a first recess and a second recess, e.g., two axially subsequent sections of the cavity.

In some embodiments, the valve comprises a valve needle. The valve needle is arranged in the cavity and received in the first recess. The valve needle is axially moveable relative to the valve body. The valve needle is operable to seal the valve in a closing position. It is axially displaceable away from the closing position for unsealing the valve. In this way, the valve needle prevents fluid injection from the injector in the closing position and enables it in further positions.

In some embodiments, the injector may comprise an armature for moving the valve needle away from the closing position. The armature may be mechanically coupled with the valve needle. The armature may be part of an actuator. The actuator may comprise a solenoid actuator that moves the valve needle.

The armature may be axially displaceable relative to the valve body and mechanically coupled to the valve needle to take the valve needle with it when it is displaced by means of a magnetic field which is generated by the solenoid when the actuator is energized. The armature may be releasably coupled with the valve needle. Alternatively, the armature may be fixedly coupled with the valve needle.

In some embodiments, the valve has a valve seat and at least one injection opening downstream of the valve seat. The valve needle may cooperate with the valve seat for sealing and unsealing the valve. In some embodiments, the valve needle rests sealingly on the valve seat in the closing position and is displaceable away from the valve seat for unsealing the valve to enable dispensing fluid through the at least one injection opening. The valve seat and/or the injection opening(s) may be comprised by the valve body or by a separate seat body which is fixed to the valve body at the fluid outlet end.

The injector may also comprise a damping element arranged within cavity, for example in the second recess. The damping element may comprise a hydraulic chamber, a piston, and an orifice. The hydraulic chamber may be positionally fixed relative to the valve body.

The orifice hydraulically connects the hydraulic chamber with the cavity. Therefore, fluid can be exchanged between the hydraulic chamber and the surrounding portion of the cavity of the valve body through the orifice, and in some embodiments, only through the orifice. The orifice may include a flow restricting orifice, e.g., a channel through a wall which delimits the hydraulic chamber.

The piston may be axially movable relative to the valve body to modify a fluid volume of the hydraulic chamber.

In some embodiments, the damping element further comprises an orifice element which comprises the orifice and a sleeve in which the piston is slideably received. The hydraulic chamber may be shaped and enclosed by the sleeve, the orifice element, and the piston. Leakage between the sleeve and the piston may be so small that it is negligible for the function of the damping element. In some embodiments, the orifice element limits the hydraulic chamber towards the fluid inlet end.

In some embodiments, the piston is mechanically coupled with the valve needle. In particular, the piston is coupled to the valve needle such that the piston reduces the fluid volume of the hydraulic chamber when the valve needle moves away from the closing position for unsealing the valve.

The orifice enables a fluid flow out of the hydraulic chamber when the piston is moved by the valve needle during its travel away from the closing position for unsealing the valve. By limiting the fluid flow out of the hydraulic chamber, the flow restricting orifice impedes the movement of the piston to reduce the fluid volume of the hydraulic chamber. This leads to a pressure increase of the fluid within the hydraulic chamber which is proportional to the velocity of the piston. Thus, the damping element provides a damping force on the valve needle to at least partially absorb a kinetic energy of the valve needle, when the valve needle moves away from the closing position for unsealing the valve.

In other words, the increased pressure within the hydraulic chamber causes a damping force that has a decelerating effect upon the piston and in turn on the valve needle due to the coupling with the piston. Since the orifice enables the fluid to flow out of the hydraulic chamber, the pressure within the hydraulic chamber and thus the damping force depend on a velocity of the piston.

Since the valve needle is coupled with the piston, the valve needle can be decelerated steadily. When the valve needle reaches its opening position, a bouncing of the valve needle and thus a non-linearity in the time dependence of the fluid flow can be prevented or at least largely reduced, hence allowing a particularly reliable and precise fluid injection. In particular, part-to-part and shot-to-shot variations may be particularly small due to the improved linearity at the transition from the opening movement to the fully open position of the valve needle.

The first recess may be narrowed towards the fluid outlet end of the valve body to enable guidance of an axial movement of the valve needle in one embodiment. In another embodiment, the seat element is shaped to function as an axial guide for the valve needle.

In some embodiments, the injector is an inward opening injector and the valve needle is operable to move towards the fluid inlet end of the valve body away from the closing position into the opening position to enable the fluid injection, taking place in an opening phase. It is further operable to move towards the fluid outlet end of the valve body into the closing position to prevent the fluid injection, taking place in a closing phase.

In some embodiments, the hydraulic chamber is positionally fixed relative to the valve body. The piston and the valve needle are releasably coupled. The damping element may be configured such that fluid can be exchanged between the hydraulic chamber and the portion of the cavity which surrounds the hydraulic chamber only through the flow restricting orifice. To put it differently, the flow restricting orifice may be the only fluid intake and the only fluid outlet of the damping element. For the sake of clarity, this does not exclude inevitable leakage—e.g., possibly at the interface with the piston—but the damping element does not provide further fluid intakes or outlets of the hydraulic chamber by design. Such a configuration may reduce the risk of undesired and/or uncontrollable needle movement in solenoid actuated injectors. In particular, the risk of the valve needle bouncing at the end of the opening transient—when the armature hits a stopper such as a pole piece of the solenoid actuator—may be reduced.

In some embodiments, the injector further comprises a return spring for biasing the valve needle towards the closing position. A spring force of the return spring may be transferred to the valve needle via the piston. In this way, the return spring may contribute to coupling the piston with the valve needle. For example, the return spring presses the piston against the valve needle. In some embodiments, the return spring is positioned in the hydraulic chamber. In this way, the injector can be easily and/or reliably calibrated. This design also saves space.

The actuator may be operable to displace the valve needle away from the closing position against the damping force of the damping element and against the spring force of the return spring.

In some embodiments, a diameter of the orifice is smaller than a diameter of the piston. The diameter of the orifice means the smallest hydraulic diameter of the orifice. The diameter of the piston means the hydraulic diameter of the end of the piston adjacent to the hydraulic chamber. In one development, the diameter of the piston is at least 10 times as large, and may be at most 40 times as large, as the diameter of the orifice.

In some embodiments, a cross-sectional area of the orifice, in particular the smallest cross-sectional area of the orifice, is smaller than a cross-sectional area of the piston. The cross-sectional area of the orifice may be 5% or less, and/or 1% or less of the cross-sectional area of the piston. It is may be 0.05% or more, for example 0.1% or more, of the cross-sectional area of the piston. In this way, the fluid flow from the hydraulic chamber through the orifice and, thus, the pressure of the fluid within the hydraulic chamber are controlled to set the damping force. The diameter of the orifice thus provides control of an at least partial absorption of the kinetic energy of the valve needle.

In some embodiments, the diameter of the piston depends on the given damping force. Advantageously, the diameter of the piston provides control of the at least partial absorption of the kinetic energy of the valve needle.

In some embodiments, the valve body comprises at least one fluid channel. The fluid channel may be shaped by the cavity. It may extend axially along the hydraulic chamber. In some embodiments, it is arranged outside of the sleeve. The fluid cannel enables a fluid communication from the fluid inlet end of the valve body to its fluid outlet end. The fluid channel enables fluid supply to the fluid outlet end and/or to the at least one injection opening.

In some embodiments, the fluid channel is arranged radially outside of the armature with respect to the central longitudinal axis.

In some embodiments, the piston and the valve needle are releasably coupled, for example by means of a form-fit engagement. This design may contribute to a facilitation of manufacturing the damping element.

In some embodiments, the sleeve has a sleeve wall. The sleeve may extend away from the first recess towards the fluid inlet end in one development. In some embodiments, the piston has a bottom surface, a top surface and a lateral surface. The piston is arranged to be axially movable within the sleeve. The bottom surface is coupled with the valve needle, for example in form-fit engagement with the valve needle. The lateral surface meets the sleeve wall such that a pressure on a fluid volume within the hydraulic chamber is increased when the piston moves towards the fluid inlet end.

In some embodiments, the return spring is coupled with the top surface of the piston with a first end and coupled with the valve body with an opposed second end. The return spring is preloaded to exert a force on the piston that pushes it towards the valve needle, e.g., towards the fluid outlet end in case of an inward opening injector.

In some embodiments, a plate is arranged to be axially movable within the hydraulic chamber. The plate may be coupled with the top surface of the piston with a first side and coupled with the first end of the return spring with an opposed second side. The plate allows for an easy and reliable transmission of the force of the return spring onto the piston and a force of the piston onto the return spring.

A cut-out drawing of an injector 1 for injecting a fluid is shown in a longitudinal section view in the FIGURE. In some embodiments, injector 1 is configured for injecting fuel into a cylinder of an internal combustion engine of, for example, a vehicle and/or an automobile.

The injector 1 has a central longitudinal axis 3 and comprises a valve with a valve body 5 and a valve needle 9. The valve body 5 of the injector 1 extends along the central longitudinal axis 3. The valve body 5 has a fluid outlet end 5*a* and a fluid inlet end 5*b* with respect to the central longitudinal axis 3. The valve body 5 has a cavity 7 comprising a first section 7*a* and a second section 7*b* which are arranged immediately adjacent to each other along the central longitudinal axis 3, with the first section 7*a* extending away from the fluid outlet end 5*a*, passing to the second section 7*b*, which extends towards the fluid inlet end 5*b*.

Within the first section 7*a* of the valve body 5, a valve needle 9 is arranged to be axially moveable. The valve needle 9 abuts a valve seat of the valve (not visible in the cut-out of the FIGURE) in a closing position to prevent a fluid flow through one or more injection openings (not visible in the cut-out of the FIGURE) the axial end 5*a* of the valve body 5. The valve needle 9 is axially displaceable away from the closing position towards an opening position to establish a gap with the valve seat for enabling a fluid flow.

The injector 1 further comprises a lifting device with an actuator 11 for moving the valve needle 9 in its axial direction for opening the injector 1, e.g., for unsealing the valve. The actuator 11 may include a solenoid actuator. A pole piece 13 and an armature 15 of the actuator 11 are arranged within the cavity 7 of the valve body 5 to establish a magnetic circuit. The magnetic circuit guides a magnetic flux of a magnetic field being generated by a coil 17 of the solenoid actuator 11 which is positioned outside of the cavity 7.

The actuator 11 interacts with the valve needle 9 via the armature 15. The armature 15 is mechanically coupled with the valve needle 9. The armature 15 establishes a form-fit engagement between a retainer surface 9*a* of the valve needle 9 and a top surface 15*a* of the armature 15 so that the armature 15 can take the valve needle 9 with it when it is moved towards the pole piece 13. The armature 15 cooperates with the valve needle 9 such that at least part of the lift generated by the actuator 11 with respect to the armature 15 is transferred to the valve needle 9, moving it in its opening position in which fluid injection is permitted.

The valve needle 9 and the armature 15 can axially move relative to each other, particularly when the valve needle 9 hits the valve seat. Also when the top surface 15*a* of the armature 15 reaches the pole piece 13 and the armature 15 stops, the valve needle 9 may continue its travel. This behavior is also called "overshoot" of the valve needle 9.

An amount of injected fluid should be—at least section wise—linear over time for achieving a reliable and predictable injection dose. When the armature top 15*a* reaches the pole piece 13 undamped, causing the armature 15 to stop abruptly, the valve needle 9 starts to bounce, which leads to a non-linear time dependence of the fluid flow at the transition from the opening movement to the fully open configuration of the valve.

To prevent the valve needle 9 from bouncing, a damping element 19 is arranged within the second section 7*b* of the cavity 7 of the valve body 5. The damping element 19 comprises a sleeve 21 that extends away from the first section 7*a* towards the fluid inlet end 5*b* of the valve body 5. The damping element further comprises a piston 23 and an orifice element 29. The sleeve 21, the piston 23 and the orifice element 29 together define—i.e. they shape and enclose—a hydraulic chamber 7*c*.

A cavity of the sleeve 21 is surrounded by a sleeve wall 21*a*. A diameter of the sleeve 21 and a diameter of the sleeve wall 21*a* may vary in order to hold the piston 23 in axially slideable fashion, the orifice element 29, and/or a return spring 25 of the injector 1.

The sleeve 21 is positionally fixed relative to the valve body 5. For example, it is in form-fit and/or press-fit engagement with the pole piece 13 which is itself fixed to the valve body 5 or in one piece with the valve body 5. The sleeve 21 may be received in a central axial opening of the pole piece 13.

The piston 23 is arranged to be axially movable with respect to the longitudinal axis 3 relative to the sleeve 21 and thus relative to the valve body 5. The piston 23 has a bottom surface 23*a*, a top surface 23*b* and a lateral surface 23*c*. A top surface 9*b* of the valve needle 9 is coupled with the bottom surface 23*a* of the piston 23, specifically via a form-fit engagement. The lateral surface 23*c* of the piston 23 meets the sleeve wall 21*a*. The sleeve wall 21*a* provides guidance for an axial movement of the piston 23.

The piston 23 is coupled with the valve needle 9 such that a movement of the valve needle 9 towards the opening position causes the piston 23 to move towards the fluid inlet end 5*b*, into thereby reducing the volume of the hydraulic chamber 7*c*. Moreover, a force causing the piston 23 to move towards the fluid outlet end 5*a* is transferred to the valve needle 9 as explained in detail in the following.

The return spring 25 is arranged within the hydraulic chamber 7*c* of the damping element 19. The return spring 25 is preloaded during assembly of the damping element 19.

A plate 27 is arranged to be axially movable within the hydraulic chamber 7*c* with respect to the central longitudinal axis 3. A first side 27*a* of the plate 27 is coupled with the top surface 23*b* of the piston 23. The coupling may be releasable or fixed. A second side 27*b* of the plate 27 is coupled with a first end 25*a* of the return spring 25, whereas the second end 25*b* of the return spring 25 is coupled with the orifice element 29 which is fixed to the sleeve 21 so that the second end 25*b* of the return spring 25 is seated at a fixed position relative to the valve body 5. Both ends of the return spring 25 may rest on spring seats of the plate 27, and the valve body 5 respectively.

The preloaded return spring 25 transfers a spring force on the valve needle 9 via the plate 27 and the piston 23. The return spring 25 is thus operable to bias the piston 23 towards the valve needle 9 and the valve needle 9 towards its closing position. Therefore, the valve needle is moved into the closing position by means of the spring force of the return spring 25 when the opening phase is finished, such that further fluid injection is prevented.

The lateral surface 23*c* of the piston 23 meets the sleeve wall 21*a* sealingly with respect to a pressure within the hydraulic chamber 7*c*. In other words, a basically fluid-tight interface—in the present context, an interface having a leakage rate which is negligible for the function of the damping element 19—is established between the lateral surface 23*c* of the piston 23 and the sleeve wall 21*a* of the sleeve 21.

In some embodiments, the injector 1 may comprise a lubricating fluid film between the lateral surface 23*c* and the sleeve wall 21*a*, while preventing pressure equalization between the hydraulic chamber 7*c* and the surrounding cavity 7.

When the valve needle 9 moves into the opening position, the piston 23 is moved to reduce a volume of the hydraulic chamber 7*c*. The orifice element 29 has a flow restricting orifice 29*a* which hydraulically connects the hydraulic chamber 7*c* to the cavity 7, specifically to the portion of the second section 7*b* which surrounds the damping element 19.

The flow restriction by the orifice 29*a* limits the fluid displacement out of the hydraulic chamber 7*c* due to the movement of the piston 23 so that the fluid in the hydraulic chamber 7*c* is pressurized and impedes the movement of the piston 23. Hence, the damping element 19 acts as a hydraulic damper during the opening phase of the injector 1. In particular, the plate 27 is designed such that the pressure within the hydraulic chamber 7*c* is independent of a diameter of the plate 27.

In some embodiments, the volume of the hydraulic chamber 7*c* is 30 $mm^3$. This causes a suitable damping force, while allowing the return spring 25 to be arranged within the hydraulic chamber 7*c*, thus saving space. The diameter of the piston 23 is for example approximately 2.5 mm. To maximize a volume displacing the fluid volume within the hydraulic chamber 7*c*, the diameter of the piston 23 is maximized with respect to a given available space. A stroke of the piston 23 is for example in the range of 40-60 μm. For example, the gap between the lateral surface 23*c* of the piston 23 and the sleeve wall 21*a* is 15 μm or less to prevent the pressure within the hydraulic chamber 7*c* to be balanced and to provide a proper guidance of axial movement of the piston 23. For example, a deviation of ±3 μm is caused by production.

The piston 23 and the sleeve 21 and/or the sleeve wall 21*a* respectively may be made of stainless steel. The sleeve 21 may be honed. The piston 23 may be turned.

The damping element 19 provides the damping force to decelerate the armature 15 and needle 9 when moving towards the fluid inlet end 5*b*, thus preventing a hard stop of the armature 15 that would cause the valve needle 9 to bounce. However, the damping force has an impact on a duration of the opening phase and thus on needle dynamics. A given damping force that decelerates the armature 15, preventing the hard stop of the armature 15 while allowing high needle dynamics can be achieved if the given damping force depends on a velocity of the valve needle 9.

The orifice 29*a* enables a fluid flow from the hydraulic chamber 7*c* into the surrounding portion of the cavity 7, thus allowing the pressure within the hydraulic chamber 7*c* to be balanced with the fluid pressure in the cavity 7. An outflow of the hydraulic chamber is controlled by the orifice 29*a*. The fluid flow rate through the orifice 29*a* depends on a diameter of the orifice 29*a*. Furthermore, the given damping force is may be proportional to the velocity of the valve needle 9, or the piston 23 respectively. It has been shown that it is possible to prevent the hard stop of the armature 15 while allowing high needle dynamics when the diameter of the orifice 29*a* is for example set to 0.15 mm. Thus, the cross-sectional area of the orifice 29*a* may be 0.36% of the cross-sectional area of the piston 23 in the present embodiment.

When the valve needle 9 moves into the closing position, the piston 23 is displaced to increase the volume of the hydraulic chamber 7*c*. Due to the flow restricting orifice 29*a*, the fluid flow rate from the cavity 7 into the hydraulic chamber 7*c* may be limited, thus leading to a dampening of the movement of the valve needle 9 in a closing phase. With advantage, the impact of the valve needle 9 on the valve seat may be damped in this way so that the risk for an unintended re-opening of the valve is particularly small.

To enable the injector 1 to inject fluid, the cavity 7 provides at least one supply channel 31, providing fluid communication between the fluid outlet end 5*a* of the valve body 5 and its fluid inlet end 5*b*. The supply channel is arranged outside of the sleeve 21, e.g., outside of the pressurized fluid volume within the hydraulic chamber 7*c*. The fluid channel 31 is further arranged radially outside of the armature 15 with respect to the central longitudinal axis 3.

The given damping force and the pressure within the hydraulic chamber 7*c* depend at least on one of the following: the volume of the hydraulic chamber 7*c*, the hydraulic diameter of the piston 23, the hydraulic diameter of the orifice 29*a* and the velocity of the piston 23.

In the embodiment shown, the plate 27, the piston 23, the sleeve 21, and the valve needle 9 are separate, releasably coupled components, allowed to move relatively to each other. Thus, a spring force from the return spring 25 upon the plate 27, leading to a movement of the plate 27 towards the fluid outlet end 5*a* is transmitted by the plate 27 on the piston 23, causing the piston 23 to move towards the fluid outlet end 5*a*. The force causing the piston 23 to move towards the fluid outlet end 5*a* is transmitted by the piston 23 to the valve needle 9, leading to a movement of the valve needle 9 towards the fluid outlet end 5*a*.

Accordingly, an actuator force from the armature 15 on the valve needle 9, leading to a movement of the valve needle 9 towards the fluid inlet end 5*b* is transmitted by the valve needle 9 on the piston 23, causing the piston 23 to move towards the fluid inlet end 5*b*. The force causing the piston 23 to move towards the fluid inlet end 5*b* is transmitted by the piston 23 to the plate 27, leading to a movement of the plate 27 towards the fluid inlet end 5*b*.

The armature 15 is coupled with the valve needle 9 such that the valve needle 9 is moved in its opening position. When the top surface 15*a* of the armature 15 reaches the pole piece 13 and the armature 15 stops, the valve needle 9 and the armature 15 can move relative to each other. Contrary to conventional solenoid driven injectors where damping of an armature movement is the main focus, the damping element 19 of the present invention damps the movement of the valve needle 9, thus contributing to a prevention of an overshooting of the valve needle 9.

To set the preload which biases the valve needle 9 against the valve seat, the injector 1 is calibrated, for example during assembly. For example, a calibration of the injector 1 comprises an adjustment of a preload of the return spring 25, dependent on the damping force of the damping element 19. In one exemplary embodiment, the preloading of the return spring 25 is controlled by the orifice element 29.

The invention claimed is:

1. An injector comprising:

a valve with a valve body and a valve needle;

an armature mechanically coupled to the valve needle for moving the valve needle away from a closing position; and a damping element; wherein the valve body extends between a fluid outlet end and a fluid inlet end along a central longitudinal axis and has a cavity, the valve needle moves in the cavity axially relative to the valve body and seals the valve when in the closing position;

the armature displaces the valve needle axially away from the closing position to unseal the valve;

the damping element is disposed within the cavity; and the damping element comprises:

a hydraulic chamber;

a piston arranged axially movable relative to the valve body and operates to modify a fluid volume of the hydraulic chamber;

the piston coupled with the valve needle to reduce the fluid volume of the hydraulic chamber when the valve needle moves away from the closing position; and a flow restricting orifice hydraulically connecting the hydraulic chamber to the cavity;

wherein the hydraulic chamber is fixed relative to the valve body;

the piston and the valve needle are releasably coupled; and the damping element allows fluid to be exchanged between the hydraulic chamber and the portion of the cavity surrounding the hydraulic chamber only through the flow restricting orifice.

2. An injector according to claim 1, further comprising a return spring biasing the valve needle towards the closing position.

3. An injector according to claim 2, wherein a spring force of the return spring is transferred to the valve needle via the piston.

4. An injector according to claim 2, wherein the return spring is disposed in the hydraulic chamber.

5. An injector according to claim 1, wherein a cross-sectional area of the orifice is smaller than a cross-sectional area of the piston.

6. An injector according to claim 1, wherein the cross-sectional area of the orifice is 1% or less and 0.05% or more of the cross-sectional area of the piston.

7. An injector according to claim 1, wherein the cavity shapes a fluid channel extending axially along the hydraulic chamber, enabling a fluid communication from the fluid inlet end of the valve body to its fluid outlet end.

8. An injector according to claim 7, wherein the fluid channel is arranged radially outside of the armature with respect to the central longitudinal axis.

9. An injector according to claim 1, wherein the piston and the valve needle are releasably coupled via a form-fit engagement.

10. An injector according to claim 1, wherein:

the damping element comprises a sleeve having an axially extending sleeve wall;

the piston has a bottom surface, a top surface, and a lateral surface;

the piston is axially movable within the sleeve, the bottom surface coupled with the valve needle, and the lateral surface meets the sleeve wall.

11. An injector according to claim 2, further comprising a plate movable within the hydraulic chamber, the plate coupled to a top surface of the piston at a first side of the plate and coupled with a first end of the return spring at an opposed second side.

12. An injector comprising:

a valve with a valve body and a valve needle;

an armature mechanically coupled to the valve needle for moving the valve needle away from a closing position; and a damping element; wherein the valve body extends between a fluid outlet end and a fluid inlet end along a central longitudinal axis and has a cavity, wherein the valve needle moves in the cavity axially relative to the valve body and seals the valve when in the closing position;

the armature displaces the valve needle axially away from the closing position to unseal the valve;

the damping element is disposed within the cavity, the damping element comprising:

a hydraulic chamber;

a piston arranged axially movable relative to the valve body and operates to modify a fluid volume of the hydraulic chamber;

the piston coupled with the valve needle to reduce the fluid volume of the hydraulic chamber when the valve needle moves away from the closing position; and a flow restricting orifice hydraulically connecting the hydraulic chamber to the cavity; and a return spring disposed in the hydraulic chamber biasing the valve needle towards the closing position.

13. An injector according to claim 12, wherein a spring force of the return spring is transferred to the valve needle via the piston.

14. An injector according to claim 12, wherein the piston and the valve needle are releasably coupled via a form-fit engagement.

15. An injector comprising:

a valve with a valve body and a valve needle;

an armature mechanically coupled to the valve needle for moving the valve needle away from a closing position; and a damping element; wherein the valve body extends between a fluid outlet end and a fluid inlet end along a central longitudinal axis and has a cavity, the valve needle moves in the cavity axially relative to the valve body and seals the valve when in the closing position;

the armature displaces the valve needle axially away from the closing position to unseal the valve;

the damping element is disposed within the cavity; and the damping element comprises:

a hydraulic chamber;

a piston arranged axially movable relative to the valve body and operates to modify a fluid volume of the hydraulic chamber;

the piston coupled with the valve needle to reduce the fluid volume of the hydraulic chamber when the valve needle moves away from the closing position; and a flow restricting orifice hydraulically connecting the hydraulic chamber to the cavity;

wherein the piston and the valve needle are releasably coupled via a form-fit engagement.

16. An injector according to claim 15, further comprising a return spring with a spring force transferred to the valve needle via the piston.

* * * * *